United States Patent [19]

Mondshine

[11] 4,014,174

[45] Mar. 29, 1977

[54] METHOD OF SIMULTANEOUSLY STRENGTHENING THE SURFACE OF A BOREHOLE AND BONDING CEMENT THERETO AND METHOD OF FORMING CEMENTITIOUS PILINGS

[75] Inventor: Thomas C. Mondshine, Houston, Tex.

[73] Assignee: N L Industries, Inc., New York, N.Y.

[22] Filed: Oct. 28, 1975

[21] Appl. No.: 626,469

[52] U.S. Cl. ..... 61/53.52; 61/53.58; 61/53.6; 166/292

[51] Int. Cl.[2] ..... E02D 5/42; E02D 5/62

[58] Field of Search ..... 61/53.52, 53.64, 56, 61/56.5, 36 B, 36, 35; 166/292

[56] References Cited

UNITED STATES PATENTS 3,884,302 5/1975 Messenger ..... 166/292

FOREIGN PATENTS OR APPLICATIONS 45-41262 12/1970 Japan ..... 61/36 B

*Primary Examiner*—Jacob Shapiro

*Attorney, Agent, or Firm*—Roy F. House; Delmar H. Larsen; Robert L. Lehman

[57] ABSTRACT

An improved method of consolidating the surface of a borehole in an incompetent formation and simultaneously strengthening the bond between the surface of the borehole and cement placed in the borehole is achieved by forcing an aqueous solution of a multivalent cation salt into the formation, thereafter forcing an alkali metal silicate solution which has a pH less than 12.0 containing at least 12% by weight silica into the formation, and thereafter forcing an aqueous cement slurry containing at least 2% by weight of a water soluble multivalent cation salt to contact the surface of the borehole. A cementitious piling intimately bonded to the formation is prepared by filing the stabilized borehole with an aqueous cement slurry and allowing the cement to harden.

10 Claims, 2 Drawing Figures

METHOD OF SIMULTANEOUSLY STRENGTHENING THE SURFACE OF A BOREHOLE AND BONDING CEMENT THERETO AND METHOD OF FORMING CEMENTITIOUS PILINGS

FIELD OF THE INVENTION

This invention relates to the fields of formation consolidation, soil stabilization, and cement bonding, particularly for preparing pilings in loosely-consolidated soils.

PRIOR ART

Methods are known for subsoil consolidation by means of pressure injecting cement, aqueous silicate solutions, resinous compositions and the like into the subsoil. Methods are also known for forming pilings in soils (see for example, U.S. Pat. No. 3,797,259 and U.S. Pat. No. 3,852,966). It is also known to form pilings for oil/gas well drilling platforms by drilling a borehole in the earth at the desired location, placing a steel casing within the borehole, forcing cement into the borehole through the casing and out the borehole through the annulus between the sides of the borehole and the casing, and thereafter allowing the cement, which fills the borehole including the casing, to set.

Pilings formed by the latter process are not stable when the formation surrounding the borehole is incompetent, i.e., is weak and porous.

SUMMARY OF THE INVENTION

I have now discovered that an imcompetent subsurface formation surrounding a borehole therein can be strengthened and consolidated while simultaneously forming a strong bond between the formation and cement placed within the borehole by forcing an aqueous salt solution containing at least 0.5% of a multivalent cation salt into the formation surrounding the borehole, displacing the salt solution from the borehole, placing an aqueous silicate solution which has a pH less than 1.20 containing at least 12 percent by weight silica within the borehole, forcing this silicate solution into the formation, displacing the silicate solution from the borehole, placing an aqueous cement slurry containing at least 2 percent by weight of a water soluble multivalent cation salt into the borehole, and forcing the cement to contact the surface of the borehole.

The alkali metal silicate placed within the pores of the formation precipitates hydrous silica and reacts with the multivalent cation present in the pores and in the "filtrate" from the cement slurry to form insoluble silicates which simultaneously strengthen the incompetent formation and form a strong bond between the cement and the formation.

Thus it is an object of this invention to provide a method of simultaneously consolidating an incompetent formation surrounding a borehole and bonding cement to the formation upon placing cement in the borehole. It is another object of this invention to provide cementitious pilings and a method for their production. Other objects of this invention will be apparent to one skilled in the art in the discussion which follows.

FIG. 1 of the drawing is a conventional flow diagram showing the process steps of this invention.

FIG. 2 of the drawing shows the completed cementitious piling of this invention.

DESCRIPTION OF THE PREFERRED EMBODIMENTS OF THE INVENTION

Figure 1:
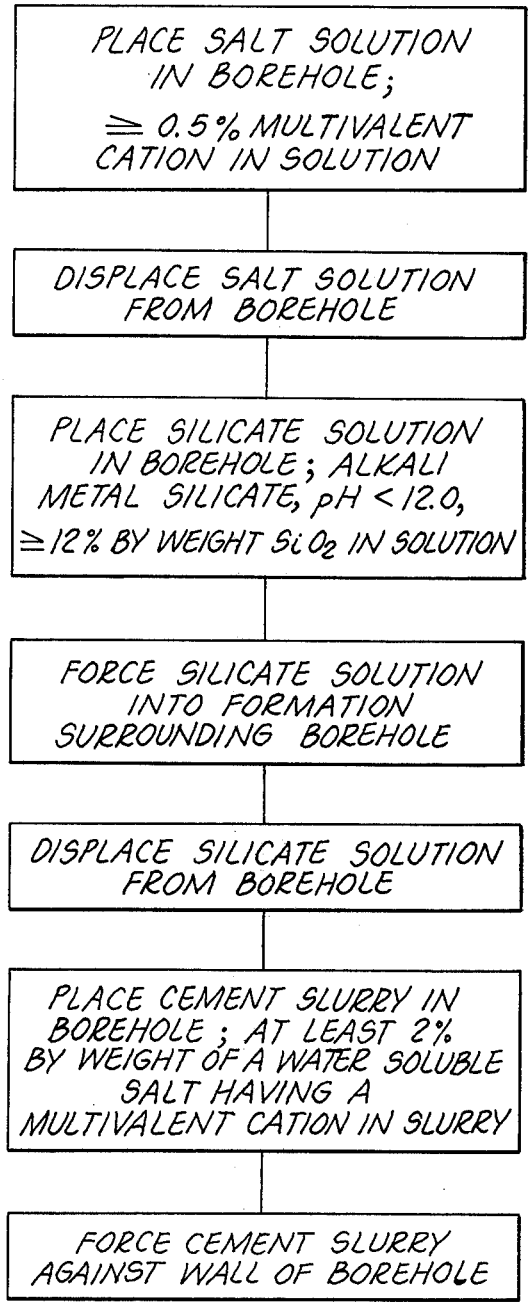

In order to strengthen the surface of a borehole which has been drilled in an unconsolidated formation and to form a strong cement bond to the formation, the formation must contain within its pores an aqueous solution which contains at least 0.5% of a multivalent cation salt. Such as aqueous solution may be naturally present in the formation, such as when the formation contains seawater, brackish water, and the like. However when the formation contains relatively fresh water, this water close to the surface of the borehole must be displaced by forcing an aqueous salt solution containing at least 0.5% of a multivalent cation salt, which is preferably seawater, from the borehole into the formation using well known displacement techniques. Preferably a tubular steel or aluminum casing is placed within the borehole and the aqueous salt solution is pumped into the borehole through this tubing and out of the borehole through the annulus between the tubing and the sides of the borehole. The annulus is then shut off and pressure is maintained on the aqueous salt solution sufficient to overcome the formation fluid pressure and force the salt solution into the formation. The tubing can be the drill pipe used to drill the borehole.

Thereafter the aqueous salt solution is displaced (removed) from the borehole such as by pumping a displacing fluid, such as a water base or oilbase mud which has a viscosity greater than the salt solution and which will not react with the silicate solution to the extent that the silicate solution is severely thickened, into the tubing forcing the solution out of the borehole. This is followed by filling at least the annulus between the tubing and the sides of the borehole with an alkali metal silicate solution which has a pH less than 12.0 containing at least 12 percent by weight silica and forcing this silicate solution into the formation. Placing the silicate solution in the annulus removes the displacing solution from the borehole. The entire borehole can be filled with the silicate solution if desired, and indeed is preferable. When only the annulus is filled with the silicate solution, the tubing must be filled with a liquid to force the silicate solution into the annulus from the tubing. The liquid cannot be reactive with the silicate solution and must have approximately the same or greater density and viscosity, preferably a greater density and viscosity, in order to prevent channeling of the liquid into the silicate solution. The silicate solution, which is preferably sodium silicate, but which may be potassium or ammonium silicate, must contain at least 12 percent by weight silica and have a pH less than 12.0, preferably less than about 11.5. The minimum pH of the silicate solution must be sufficient to keep all of the silica in solution and is generally at least 11.0.

The silicate solution is then displaced from the borehole, preferably by pumping a fluid which will not thicken the silicate solution into the tubing forcing the silicate solution through the annulus and out of the top of the borehole. Thereafter a cement slurry containing at least 2% by weight of a water soluble multivalent cation salt, such as the acetate, chloride, nitrate or sulfate salts of calcium, magnesium, aluminum, iron and the like multivalent cations, is placed within the borehole and pumped down the tubing and into the annulus between the tubing and the sides of the borehole. Sufficient cement slurry is used to at least fill the annulus with cement. The whole borehole including the tubing can be filled with cement in which case the cement upon hardening forms a cementitious piling within the sub-surface formation. The cement slurry is forced to contact the sides of the borehole whereupon a strong bond between the formation and the cement occurs as a result of the reaction of the water soluble multivalent cation salt in the cement with the alkali metal silicate solution in the pores of the formation. Simultaneously the formation surrounding the borehole is strengthened and consolidated. Preferably the water soluble multivalent cation salt is present in the cement at a concentration of at least 4% by weight. Preferably the multivalent cation salt is calcium chloride.

Displacing fluids which are not reactive with silicate solutions and thus are effective in the practice of this invention are preferably thickened oils such as oil base and invert emulsion drilling fluids. Fresh water base drilling fluids thickened with polymers such as those disclosed in U.S. Pat. No. 3,198,268 can also be used as displacing fluids.

When it is desired to form a piling in the sub-surface formation, it is only necessary that the cement slurry which contacts the formation contain a water soluble multivalent cation salt. The cement slurry which is used to fill the casing can be any of the well known cement slurries used in construction or in cementing oil/gas wells and the like, and indeed can be the base cement slurry to which the multivalent cation salt is added to form the cement slurry which contacts the formation. The cementitious piling so formed thus consists of a central core of cement surrounded by a tubular casing which is surrounded by an outer cement coating and which in turn is surrounded by a multivalent cation silicate coating which intimately bonds the piling to the sub-surface formation.

When it is not desired to form a cementitious piling within the borehole, then the cement slurry containing the water soluble multivalent cation salt must be forced to fill the annulus and contact the sides of the borehole with a liquid for the casing which will not react with the cement slurry and which preferably has a density and viscosity greater than the density and viscosity of the cement slurry. Advantageously a weighted oleaginous composition such as an oil base mud, invert emulsion mud, or an oil base spotting fluid can be used.

Figure 2:
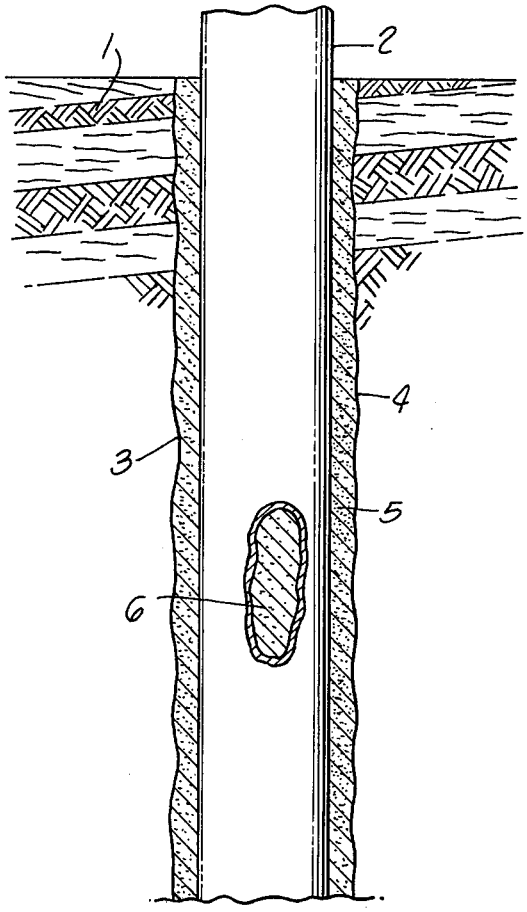

In FIG. 2, an exemplary section illustrating the completed cemented piling is shown. A casing 2 is connected within a borehole 3, 4 in an incompetent formation 1. The annular space 5 between the casing and the walls of the borehole is filled with cement, as is the interior 6 of the casing itself.

Illustrative examples of the invention follow.

EXAMPLE 1

Several tests were conducted in order to evaluate the effects of the type of water present in the formation, the concentration of silica and the pH of the silicate solution used to impregnate the formation, and the concentration of water soluble multivalent cation salt present in the cement on the properties of the cement-formation bond and of the formation. For each test a soil bed of 2 cm. thickness was made by placing an Oklahoma silica sand having an AFS Fineness No. 83.2 directly on the screen in a standard API drilling fluid filtration cell. No filter paper was used. Before placement of the sand, the inner surface of the cell was coated with grease so that subsequent cement cores could be readily ejected for examination. The soil beds were then saturated with the water indicated in Table 1 and the excess fluid drained off. The wet soil beds were soaked for 30 minutes before introduction of the silicate solution.

About 200 ml. of sodium silicate solution having the composition indicated in Table 1 were poured onto the watersaturated soil bed. Air pressure of 5–15 psi was applied to force the silicate solution into the soil bed. Pressure was maintained until silicate appeared in the filtrate. The cells were then sealed for 1.5 to 2 hours. Subsequently the cells were opened and excess silicate solution discarded. Cement slurry containing the concentration of calcium chloride indicated in Table 1 was added to each cell to give a 5 cm. thick layer of cement. The base cement slurry contained 486 p.p.b. (pounds per barrel of slurry) cement in fresh water and had a density of 15.6 lb./gal. Air pressure of 10–15 psi was applied to force the cement slurry against the soil bed and to force a "filtrate" from the cement slurry into the soil bed. The amount of liquid removed from the test cell is indicated in Table 1. Thereafter the cell contents were allowed to set 16 hours before ejecting and examining the cement-soll bed cores so formed. The quality of each soil bed was studied as to resistance to shear and apparent firmness, and the nature of the cake bonding the cement to the soil bed was also examined. The results obtained are indicated in Table 1.

The sea water used in these examples was a synthetic sea water containing 4.2% by weight of a synthetic sea salt which contains 54.49% NaCl, 26.46% $MgCl_2 \cdot 6 H_2O$, 9.75% $Na_2SO_4$, 2.765% $CaCl_2$, 1.645% KCl, 0.477% $NaHCO_3$, 0.238% KBr, 0.071% $K BO_3$, 0.095% $SrCl_2 \cdot 6 H_2O$, 0.007% NaF.

TABLE 1

| | Test Number | | | | | | |
|---|---|---|---|---|---|---|---|
| | 1 | 2 | 3 | 4 | 5 | 6 | 7 |
| Water Saturating Sand Bed | | | | | | | |
| Seawater | x | x | x | x | x | x | |
| Fresh Water | | | | | | | x |
| Silicate Solution | | | | | | | |
| $SiO_2$, % | 17.3 | 17.3 | 17.3 | 17.3 | 17.3 | 14.1 | 17.3 |
| $SiO_2/Na_2O$, w/w | 4.0 | 4.0 | 4.0 | 2.8 | 2.0 | 4.0 | 4.0 |
| pH | 11.4 | 11.4 | 11.4 | 12.0 | 13.0 | 11.4 | 11.4 |
| Cement Slurry | | | | | | | |
| $CaCl_2$, % | 0 | 2 | 4 | 4 | 4 | 4 | 4 |
| Filtrate Removed from Sand Bed, ml. | 92 | 23 | 17 | 44 | 40 | 37 | 63 |
| Properties of Cement-Sand Bond | | | | | | | |
| No Bond | x | | | x | x | | x |

TABLE 1-continued

| | Test Number | | | | | | |
|---|---|---|---|---|---|---|---|
| | 1 | 2 | 3 | 4 | 5 | 6 | 7 |
| Hard Bond | | x | | | | x | |
| Excellent Bond | | | x | | | | |
| Properties of Wet Sand Bed* | | | | | | | |
| A | x | | | | | | |
| B | | | | | x | | x |
| C | | x | | x | | x | |
| D | | | x | | | | |

*A = Soft, sand bed crumbled under very light shear
B = Soft, sand bed crumbled under light hand shear
C = Firm, sand bed crunbled under moderate hand shear
D = Hard, sand bed resisted strong hand shear

EXAMPLE 2

TABLE 2

| | Test Number | | | | | | | |
|---|---|---|---|---|---|---|---|---|
| | 8 | 9 | 10 | 11 | 12 | 13 | 14 | 15 |
| Water Saturating Soil Bed | | | | | | | | |
| Seawater | x | x | x | x | | | | |
| 4% Sodium Chloride | | | | | x | | | |
| 1% Magnesium Chloride | | | | | | x | | |
| 2% Magnesium Chloride | | | | | | | x | |
| 4% Magnesium Chloride | | | | | | | | x |
| Silicate Solution | | | | | | | | |
| $SiO_2$, % | 11.5 | 8.65 | 17.3 | 17.3 | 17.3 | 17.3 | 17.3 | 17.3 |
| $SiO_2/Na_2O$, w/w | 4.0 | 4.0 | 3.3 | 4.0 | 4.0 | 4.0 | 4.0 | 4.0 |
| pH | 11.1 | 11.0 | 11.3 | 11.0 | 11.0 | 11.0 | 10.9 | 11.0 |
| Cement Slurry | | | | | | | | |
| $CaCl_2$, % | 4 | 4 | 4 | | 4 | 4 | 4 | 4 |
| $MgCl_2$, % | | | | 4 | | | | |
| Filtrate Removed from Sand Bed, ml. | 10 | 10 | 10 | 10 | 25 | 25 | 20 | 20 |
| Properties of Cement-Sand Bond | | | | | | | | |
| No Bond | x | x | | | x | | | |
| Hard Bond | | | | x | | x | | x |
| Excellent Bond | | | x | | | | x | |
| Properties of Wet Sand Bond* | | | | | | | | |
| A | | x | | | x | | | |
| B | x | | | | | | | |
| C | | | | x | | x | | x |
| D | | x | | | | x | | |

*See Table 1 footnotes.

Several tests were conducted using the procedures indicated in Example 1 wherein the soil bed was prepared from a synthetic silty sand comprising a mixture of 90% by weight Oklahoma silica sand having an AFS Fineness No. of 83.2 and 10% by weight Glen Rose shale. The data obtained are given in Table 2.

The data in Tables 1 and 2 clearly indicate that, for effective consolidation of underground formations and bonding of cement to the formations:

(1) the formation must contain within its pores an aqueous solution containing at least about 0.5% of at least one multivalent cation salt, which is preferably seawater;

(2) the silicate solution must contain at least about 12% by weight silica and have a pH less than 12.0, hence a silica to alkali metal oxide weight ratio greater than 2.8; and (3) the cement must contain at least 2% by weight of an alkaline earth metal salt, preferably at least 4%.

EXAMPLE 3

Several tests were conducted using the evaluation procedures of Example 1. The soil beds were prepared using two natural silty sands. Soil A was obtained at a depth of 198.5 feet at the Tuna Mackerel Project Offshore, Soil B was obtained at a depth of 71 feet. In these tests the soil beds were saturated with seawater. Two of the tests were conducted using either asbestos (chrysotile from Coalinga, Ca.) or attapulgite as viscosifiers in the sodium silciate solution. The data obtained are given in Table 3.

The data indicate that the seawater saturated soils could be adequately strengthened and cement could be simultaneously adequately bonded to the soil using the process of this invention.

TABLE 3

| | Test Number | | | | | | |
|---|---|---|---|---|---|---|---|
| | 16 | 17 | 18 | 19 | 20 | 21 | 22 |
| Silicate Solution | | | | | | | |
| $SiO_2$, % | 0 | 0 | 18.0 | 18.0 | 18.0 | 18.0 | |
| $SiO_2/Na_2O$, w/w | | | 4.0 | 4.0 | 4.0 | 4.0 | 4.0 |

TABLE 3-continued

| | Test Number | | | | | | |
|---|---|---|---|---|---|---|---|
| | 16 | 17 | 18 | 19 | 20 | 21 | 22 |
| pH | | | 11.1 | 11.1 | 11.1 | 11.1 | 11.1 |
| Asbestos | | | 0 | 0 | 3 | 0 | 0 |
| Attapulgite | | | 0 | 0 | 0 | 6 | 0 |
| Soil Used for Soil Bed* | A | A | A | A | A | B | B |
| Cement Slurry | | | | | | | |
| $CaCl_2$, % | 0 | 4 | 0 | 4 | 4 | 4 | 4 |
| Filtrate Removed from Soil Bed, ml. | 50 | 50 | 50 | 15 | 8 | 8 | 20 |
| Properties of Cement-Sand Bond | | | | | | | |
| Soft, No Bond | x | x | x | | | | |
| Firm, Hard Bond | | | | | | x | |
| Hard, Excellent Bond | | | | x | x | | x |
| Properties of Wet Soil Bed** | | | | | | | |
| A | x | x | x | | | | |
| B | | | | | | | |
| C | | | | | | x | |
| D | | | | x | x | | x |

*Soil A = 19.5% moisture, 1.9 milliequivalents/100 gram Methylene Blue Dye Capacity.
Soil B = 1.0% moisture, 1.0 milliequivalents/100 gram Methylene Blue Dye Capacity.
**See Table 1 footnotes.

EXAMPLE 4

A borehole is drilled in a porous formation containing relatively fresh water. A steel casing is placed in the borehole. Thereafter a solution containing at least 0.5% by weight of calcium chloride is pumped down the casing and back to the surface through the annulus. The formation possesses enough permeability that the solution readily enters the formation under the hydrostatic pressure in the borehole. This solution is displaced from the borehole by pumping an oil base mud having a density of 8.5 pounds per gallon and a plastic viscosity of 2.5 centipoises into the borehole through the casing. Thereafter the displacing fluid is removed from the borehole by pumping a sodium silicate solution containing 17.3% silica having a pH of 11.4 and a plastic viscosity of 4 centipoises into the borehole through the casing. The silicate solution allowed to remain in the borehole for 4 hours is subsequently displaced by pumping an oil base mud having a density of 13 pounds per gallon and a plastic viscosity of 10 centipoises into the borehole through the casing. The oil base mud is displaced by filling the borehole, including the annulus and casing, with a cement slurry containing 3% by weight calcium chloride and 475 pounds of cement per barrel of slurry in fresh water, the slurry having a density of 15.5 pounds per gallon. Again the annulus is closed off and the pump pressure increased to force the cement slurry firmly against the formation and force some "filtrate" from the cement slurry into the formation. Thereafter the cement is allowed to harden forming a cementitious piling in the formation.

I claim:

1. A method for simultaneously consolidating the surface of a borehole and bonding cement to the surface of said borehole, which comprises:

a. placing an aqueous salt solution containing at least 0.5% of a multivalent cation salt into a borehole;
b. forcing said salt solution into the formation surrounding said borehole;
c. displacing said salt solution from said borehole;
d. placing an alkali metal silicate solution which has a pH less than 12.0 containing at least 12 percent by weight silica within said borehole;
e. forcing said silicate solution into said formation;
f. displacing said silicate solution from said borehole;
g. placing an aqueous cement slurry containing at least 2 percent by weight of a water soluble multivalent cation salt within said borehole; and
h. forcing said cement to contact said surface of said borehole.

2. The method of claim 1 wherein said salt solution is seawater, and wherein said alkali metal is sodium, and wherein said water soluble multivalent cation salt in said cement is calcium chloride.

3. The method of claim 2 wherein said silicate solution has a pH less than about 11.5.

4. The method of claim 3 wherein said cement contains at least 4% by weight calcium chloride.

5. The method of claim 4 wherein the stabilized borehole is filled with a cement slurry to form a piling in said formation.

6. The method of claim 2 wherein the stabilized borehole is filled with a cement slurry to form a piling in said formation.

7. The method of claim 6 wherein said cement slurry which contacts the surface of said borehole contains at least 4% by weight calcium chloride.

8. The method of claim 1 wherein the stabilized borehole is filled with a cement slurry to form a piling in said formation.

9. The method of claim 8 wherein said silicate solution has a pH less than about 11.5.

10. A method for simultaneously consolidating the surface of a borehole and bonding cement to the surface of said borehole, wherein said borehole is within an incompetent formation beneath a body of seawater, and for forming a piling within said borehole, which comprises:

a. placing an alkali metal silicate solution which has a pH less than 12.0 containing at least 12 percent by weight silica within said borehole;
b. forcing said silicate solution into said formation;
c. displacing said silicate solution from said borehole;
d. placing an aqueous cement slurry containing at least 2% by weight of a water soluble multivalent cation salt within said borehole;
e. forcing said cement to contact said surface of said borehole; and
f. allowing said cement slurry to harden; wherein said borehole is filled with a cement slurry to form a piling in said formation.

* * * * *